United States Patent [19]

McNamara et al.

[11] 4,123,492

[45] Oct. 31, 1978

[54] NYLON 66 SPINNING PROCESS

[75] Inventors: Michael M. McNamara, Jalisco, Mexico; Wayne T. Mowe; Darwyn E. Walker, both of Pensacola, Fla.

[73] Assignee: Monsanto Company, St. Louis, Mo.

[21] Appl. No.: 577,951

[22] Filed: May 22, 1975

[51] Int. Cl.[2] ..... D01D 5/12

[52] U.S. Cl. ..... 264/210 F; 264/290 N

[58] Field of Search ..... 264/176 Z, 210 Z, 103, 264/290 N

[56] References Cited

U.S. PATENT DOCUMENTS

| | | | |
|---|---|---|---|
| 2,888,711 | 6/1959 | Finlayson et al. | 264/323 |
| 3,002,804 | 10/1961 | Kilian | 264/178 E |
| 3,053,611 | 9/1962 | Griehl | 264/176 F |
| 3,053,611 | 9/1962 | Griehl | 264/176 F |
| 3,229,330 | 1/1966 | Ferrier et al. | 264/210 F |
| 3,346,684 | 10/1967 | Gosden | 264/176 F |
| 3,511,905 | 5/1970 | Martin | 264/210 F |
| 3,550,369 | 12/1970 | Pitzl | 264/176 F |
| 3,553,305 | 1/1971 | Au | 264/176 F |
| 3,715,421 | 2/1973 | Martin et al. | 264/210 F |
| 3,752,457 | 8/1973 | Parmeggiani et al. | 264/176 F |
| 3,761,556 | 9/1973 | Thom et al. | 264/210 F |
| 3,816,992 | 8/1974 | Frankfort et al. | 264/210 F |
| 3,837,156 | 9/1974 | Langanke et al. | 57/157 TS |
| 3,946,100 | 3/1976 | Davis et al. | 264/176 F |
| 3,979,496 | 9/1976 | Schwarz | 264/210 F |
| 3,987,136 | 10/1976 | Schippers | 264/210 F |

FOREIGN PATENT DOCUMENTS 2,204,397 8/1973 Fed. Rep. of Germany.

OTHER PUBLICATIONS

"Stretch Texturing - Status and Devel." by Prof. Lunenschloss, Chemietasern & Textol Annendungstechnok und Fietrchudr, fur die gesamte Textilindustrie 23/75, 1067-1068, 1070-1073, 1076-1080 (1973), Nov.

*Primary Examiner*—Jay H. Woo

*Attorney, Agent, or Firm*—Kelly O. Corley

[57] ABSTRACT

Polyamide yarn is melt spun at high speed and drawn almost immediately (between 0.002 and 0.25 seconds) after solidification. Turbine driven feed roll replaces conventional feed and separator roll. Process displays unusually low drawing tension, exceptionally uniform yarn.

40 Claims, 4 Drawing Figures

NYLON 66 SPINNING PROCESS

The invention relates to novel processes for melt spinning polyamide yarns having a novel combination of physical properties and excellent uniformity.

As used in the specification and claims, the term "polyamide" means the class of synthetic linear melt-spinnable polymers having recurring amide linkages, and includes both homopolymers and copolymers, while the term "nylon 66" shall mean those synthetic linear polyamides containing in the polymer molecule at least 85% by weight of recurring structural units of the formula $$\left[ -\overset{\overset{\displaystyle O}{\|}}{C}-(CH_2)_4-\overset{\overset{\displaystyle O}{\|}}{C}-\overset{\overset{\displaystyle H}{|}}{N}-(CH_2)_6-\overset{\overset{\displaystyle H}{|}}{N} \right]$$

The polymers and resulting yarns may contain the usual minor amounts of such additives as are known in the art, such as delustrants or pigments, light stabilizers, heat and oxidation stabilizers, additives for reducing static, additives for modifying dyeability, etc. The polymers must be of fiber-forming molecular weight in order to melt spin into yarn. The term "yarn" as used herein includes continuous filaments and staple fibers.

One prior art process for making polyamide yarn is the conventional melt spinning process wherein the spun yarn is collected on spin cakes or packages, the spin cakes then being removed from the spinning machine and placed on drawing machines where the drawing operation is performed. By way of example, spun yarn having 88 denier can be collected at 1371 meters per minute (1500 y.p.m.), corresponding to a throughput of 28.7 grams per minute per spinning position. This spun yarn is then drawn to 70 denier on a separate machine. Productivity per spinning position is thus reasonably high, but the discontinuous or split process is expensive because of the necessity for manually handling the spun yarn, and the drawn yarn properties are somewhat variable.

A second known process for making polyamide yarn is a continuous or coupled process wherein the freshly spun yarn is fed in several wraps around a feed roll and separator roll running at a given peripheral speed to a draw roll and associated separator roll running at a higher peripheral speed, the yarn then being packaged. Optionally, the yarn may be subjected to two successive drawing stages as disclosed in U.S. Pat. No. 3,091,015. While coupled process yarn is usually more uniform than yarn produced by the split process, measurable denier variations along the yarn still occur. In addition, drawing and winding speeds in the coupled process are generally limited to less than about 3200–3657 meters per minute (3500–4000 yards per minute) in practice because of increasingly poor performance and decreased yields of prime quality yarn as speed is increased. This then limits the practical spinning speed and hence the productivity of a spinning position to less than those of a split process spinning position. A spinning position making 70 drawn denier yarn by the coupled process at 3200 meters per minute (3500 yards per minute) will have a throughput of only 24.9 grams per minute. In effect, therefore, the coupled process permits gains in product quality at the expense of productivity per spinning position.

According to the invention, these and other difficulties are avoided by a novel process having a number of aspects applicable to polyamide yarns generally, and other aspects specific to nylon 66 yarn. Yarn according to the invention can have uniformity superior to the best yarns made by the coupled process, and with higher productivity than either the split or the coupled processes. Thus, 70 denier yarn according to the present invention can readily be made with excellent yields at speeds of 6000 meters per minute or far higher. At 4572 meters per minute, throughput for this denier is 35.6 grams per minute per spinning position. This is about 24% more productivity than the split process and about 43% more productivity than the coupled process.

In addition to the lowered manufacturing cost permitted by the higher productivity, the nylon 66 yarn of the invention typically exhibits in fabric form a distinctive soft, luxuriant hand, particularly when the yarn is textured prior to incorporation in the fabric.

As is known, the hand of fabrics (the way they feel to the touch) depends not only on the initial properties of the yarn, but also on the fabric construction and on the conditions to which the fabric is subjected during scouring, dyeing and finishing. Various test fabrics made from yarns according to the invention exhibit a distinctive soft, luxuriant hand when compared to otherwise identical control fabrics made from conventional nylon 66 yarns having the same denier and number of filaments, the fabrics having been scoured, dyed and finished under the same conditions.

These test fabrics do not feel crisp to a light touch, as do fabrics made from wool, silk, or conventional nylon 66, and accordingly are more comfortable in garments worn next to the skin. Generally speaking, the soft hand is more apparent in heavier fabric constructions than in lighter constructions. for example, yarns textured by the false-twist heat-set process and knitted as 210 denier, 102 filament, balanced-torque plied yarns into mens' half-hose have a softer hand with test yarns according to the invention than with either split process or coupled process control yarns. The soft hand is typically not as pronounced in lighter constructions. Thus, sample tubes knitted from 70 denier, 34 filament flat test and control yarns on the Lawson-Hemphill Fiber Analysis Knitter exhibit smaller hand differences than in the mens' half-hose mentioned above, although the hand differences are still detectable.

According to one of the broadest aspects of the invention, thermoplastic melt-spinnable polyamides (either homopolyamides and copolyamides) of fiber-forming moleuclar weight as a class can be processed into novel yarns having a variety of uses by extruding the polymer through a spinneret as a plurality of molten streams into a quench zone wherein the streams are cooled and solidified into spun filaments, forwarding the spun filaments with spinning speed control means for controlling the spinning speed by withdrawing the spun filaments from the quench zone at a spinning speed of at least 2285 meters per minute, feeding the filaments into a draw zone between 0.002 and 0.25 seconds (preferably between 0.01 and 0.12 seconds) after solidification of the filaments, and stretching the filaments in the draw zone. It has been discovered that, under these conditions, exceptional denier uniformity is obtained and the yarn requires such low force to draw that a considerable simplification of apparatus is possible. Thus, the customary electrically driven spinning speed controlling feed roll with its motor and associated separator roll can be replaced by a single unpaired roll which alone contacts the yarn between the quench zone and the draw zone.

As a further major aspect of the invention, the spun yarn passes in a single wrap about the feed roll, thus eliminating the need for the customary associated skewed separator roll for separating a plurality of adjacent wraps. Preferably this wrap is a partial wrap (less than 360° contact) with the feed roll.

A further major aspect of the process is the use of a yarn processing roll (such as the feed roll) which is driven by a substantially constant torque, rather than the usual roll driven at constant speed. The peripheral speed of such a feed roll has been observed to vary by one percent or more about its mean value as reported below in Table 2 within a minute, while the process is producing exceptionally uniform yarn. It appears that the speed of the feed roll may vary in accordance with small variations of physical properties such as viscosity or the like in the molten polymer streams, and that the speed variation compensates for the physical property variation so as to assist in producing a more uniform yarn.

As a further aspect of the process, the substantially constant torque is supplied by an air turbine. During startup, it is very difficult to stringup the machine if the feed roll is driven at a fixed high rate of speed such as in Item A in Table 2 below (3814 meters per minute), since the yarn repeatedly breaks back when brought in contact with the roll. With the air turbine and air bearing, the turbine air supply can re reduced or turned off while stringing up or guiding the yarn from the spinneret into contact with the various rolls and to the winding mechanism. It has been found that the stringup procedure can be performed quite readily, after which the turbine air supply can be set to the proper value.

According to further major aspect of the invention, the air turbine applies a torque to the roll in a direction to oppose driving of the roll by the yarn. This permits control of the tension in the draw zone independent of the speed of the draw roll.

As a further major aspect of the invention, the filaments are forwarded from the draw zone to a heat treatment zone and heated while under a tension between 0.1 and 1.5 grams per final denier to a yarn temperature between 50° C. and 240° C. for a period of time sufficient to reduce the underdrive to less than 5%. Underdrive is the percentage by which the speed of the winding mechanism is less than the speed of the draw roll. In one series of experiments, the polymer extrusion rate was adjusted so as to wind 75 denier yarn with the draw roll at 131° C. and running at 4571 meters per minute, and the speed of the winding mechanism was also adjusted to provide a winding tension of 7–10 grams. When the yarn had 18.7 milliseconds contact time with the draw roll, the winding speed was only 3573 meters per minute, while with 37.3 milliseconds contact time, the winding speed was 4560 meters per minute. The percentage underdrive was thus reduced from about 22% to about 0.2 percent. The significance of this is that ordinarily safety considerations limit the speed of thermally stressed heated rolls such as the draw, and for a given speed of the draw roll, greater productivity is provided by reducing the underdrive.

As a further major aspect of the invention the yarn is heat-treated under the tension and temperature conditions specified in the previous paragraph until the yarn retraction is reduced to less than 1%. This permits use of inexpensive bobbins instead of the much heavier bobbins which would be required if the retraction exceeded 1%.

According to one of the aspects of the process as specifically applied to nylon 66, the spinning speed is selected so that a final spun yarn sample (i.e., a yarn sample taken just prior to the feed roll) has a Herman crystalline orientation function $F_c$ of at least 0.78 and preferably at least 0.85. This degree of crystalline orientation in a spun (as opposed to drawn or partially drawn) yarn just prior to first entry into a draw zone is believed to contribute to the observed high crystalline orientation in the final oriented yarn and low tensions during drawing. Typical values of $F_c$ for spun yarn for known split process yarn are 0.6 to 0.7, while those for the spun yarn just prior to entering the draw zone is known coupled processes are typically considerably lower, less than 0.5.

According to a second aspect of the invention as specifically applied to nylon 66, the spinning speed is selected so that a final spun yarn sample has a crystallite hydrogen bonded sheet width no greater than 85% (preferably less than 75%) of the crystallite hydrogen bonded sheet width of a reference spun yarn sample. Typical values for this dimension is exemplary final spun yarn samples processed according to the invention are about 60–70 angstroms, while this dimension in a reference spun yarn sample is about 105–125 angstroms. This smaller crystallite dimension at the time of drawing is believed to contribute to the observed apparent ease of drawing, to the excellent denier uniformity of the yarn, and to the unusual physical properties of the yarn such as the soft hand phenomenon.

Other aspects will appear in part hereinafter and will in part be obvious from the following detailed description taken in connection with the accompanying drawings, wherein.

Figure 1:
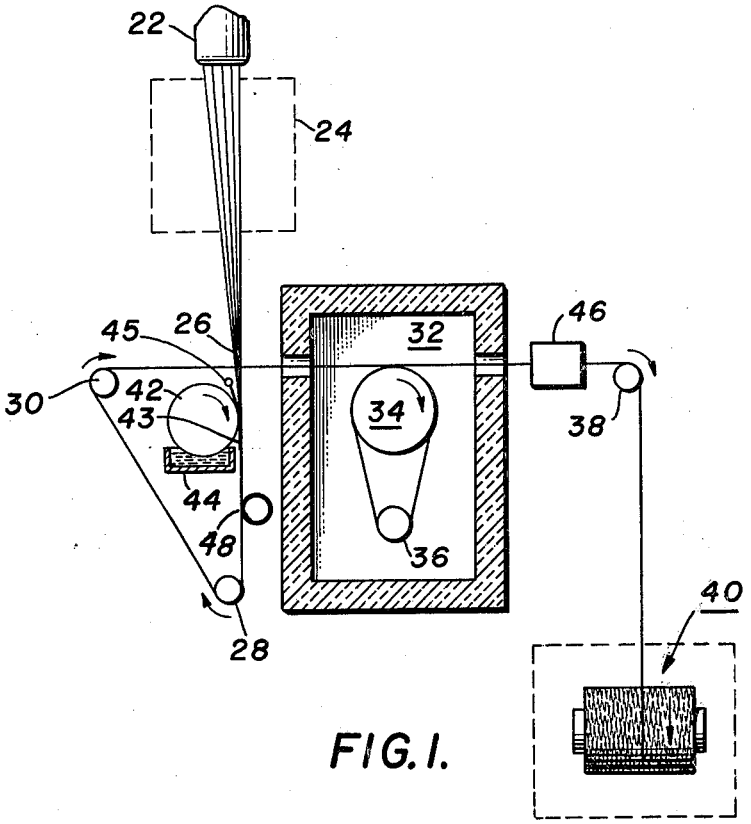
FIG. 1 is a schematic elevation view of the preferred apparatus for producing the novel yarns.
Figure 2:
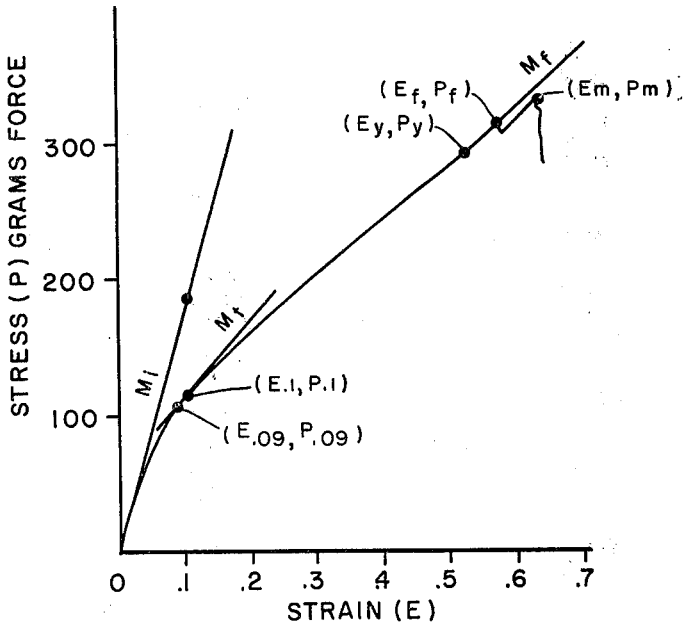
FIG. 2 shows the stress-strain properties of the yarn.

As illustrated in FIG. 1, molten yarn 66 polymer is metered and extruded from a non-illustrated conventional block through spinneret 22 into quench zone 24 as a plurality of molten streams. The streams are cooled and solidified in zone 24 by a flow of transversely moving air into filaments which constitute yarn 26. Yarn 26 passes in a partial wrap around feed roll 28 into the draw zone, then around optional intermediate roll 30 prior to entering insulated chamber 32. Driven heated draw roll 34 and its associated or paired skewed separator roll 36 are mounted within chamber 32 for drawing and forwarding yarn 26, which passes in several separated wraps around rolls 34 and 36 prior to leaving chamber 32. Yarn 26 next passes in a partial wrap around roll 38 and then downwardly to schematically illustrated yarn winding apparatus 40.

In this embodiment, spin finish is applied by slowly rotating conventional finish roll 42, whose lower surface is immersed in liquid finish carried in trough 44. A conventional gauze finish skirt 43 transfers the finish from roll 42 to yarn 26, skirt 43 being anchored at 45. While finish roll 42 is located above feed roll 28 as illustrated, it may be located between rolls 28 and 30 or at other locations. Optionally, the filaments of yarn 26 may be interlaced or entangled by an interlacing apparatus 46 of any desired design.

Rolls 28, 30 and 38 may be supported on air bearings, and at least one rolls 28 and 30 may be driven at a controlled torque or speed for controlling the tension of the yarn entering chamber 32. Roll 38 may be driven at a controlled speed for or torque adjusting the tension in yarn 26 passing through device 46, and for adjusting the winding tension.

PREFERRED APPARATUS

The following is a specific example of preferred exemplary apparatus for preparing the novel yarn according to the invention. A 34-capillary spinneret is used, the diameter and length of each capillary being 0.2286 and 0.3048 millimeters (0.009 inch and 0.012 inch), respectively. Each of rolls 28, 30 and 28 have a diameter of 4.8463 centimeters (1.908 inches) in the region of yarn contact, while rolls 34 and 36 have respective diameters of 19.3675 and 5.08 centimeters (7.625 and 2.0 inches). Roll 28 is located 424.18 centimeters (167 inches) below spinneret 22. Yarn 26 contacts roll 28 in a partial wrap of about 170°, and contacts roll 30 in a partial wrap of about 100°. The distance from roll 28 to roll 30 is 88.9 centimeters (35 inches), while the distance from roll 30 to roll 34 is 30.48 centimeters (12 inches). Roll 34 is internally heated to desired surface temperatures as indicated below. Separator roll 36 is spaced from roll 34 so that 8 wraps of yarn 26 about rolls 34 and 36 will give a total yarn contact time with feed roll 34 of about 38 milliseconds when draw roll 34 has a peripheral speed of 4572 meters (5000 yards) per minute. The distance from roll 34 to roll 38 is 50.165 centimeters (19.75 inches).

Conventional spin finish is applied to yarn 26 by roll 42 at a level of one weight percent oil on yarn. Optional roll 48 is identical to rolls 28, 30 and 38, and is positioned to control and stabilize the small degree of wrap of yarn 26 about roll 42 and skirt 43. Preferably yarn 26 is deflected only slightly by roll 42 and skirt 43, a partial wrap of only one or two degrees usually being sufficient.

Rolls 28, 30, 38 and 48 are supported on air bearings, fed from a first source of pressurized air, and are equipped to be driven by air turbines constructed according to New Departure Hyatt Bearings' Drawing XB-21044. These rolls are available from New Departure Hyatt Bearings, Sandusky, Ohio. The turbines are supplied with air from separate source of pressurized air, the turbine air for each turbine being fed through a nozzle having a throat diameter of 1.600 millimeter (0.063 inch). Each nozzle diameter increases near the exit in a region beginning 1.5875 millimeters (1/16 inch) from the nozzle exit and extending to the exit in the form of a segment of a 16° cone. The nozzle is positioned adjacent the turbine and aligned so that the following approximate relationships are obtained with no yarn on the roll.

TABLE 1

| SUPPLY PRESSURE, KILOGRAMS PER SQUARE METER GUAGE | RPM OF ROLL |
|---|---|
| 7031 | 9000 |
| 14062 | 15000 |
| 21093 | 19500 |
| 28124 | 24000 |
| 35155 | 28000 |
| 42186 | 31000 |

As reported in the following table, positive air pressure indicates that the turbine assists the yarn in driving the roll in the direction of yarn travel, while a minus sign (−) before air pressure indicates that the turbine is reversed so that the roll would rotate in the opposite direction if not contacted by the yarn. The roll in contact with the yarn thus runs increasingly slowly as "negative" air pressure (pressure preceded by a minus sign) increases.

EXEMPLARY SPECIFIC PROCESSES

Table 2 discloses several exemplary processes for operating the FIG. 1 apparatus so as to produce the novel yarns of the invention. The polymer contains 2% $TiO_2$ by weight and is selected so that the resulting yarn will have a relative viscosity of about 48–50. For all items, quenching air is supplied at a temperature of 20° C. and a relative humidity of 98%. The average velocity of the quenching air is 25.389 meters (83.3 feet) per minute, and the height of quench zone 24 is 116.84 centimeters (46 inches).

The reported tensions are as follows: $t_1$ is measured down-stream of roll 38, $t_2$ is measured between device 46 and roll 38, $t_3$ is measured as the yarn leaves chamber 32, $t_4$ is measured between roll 30 and chamber 32, $t_5$ is measured between rolls 28 and 30, $t_6$ is measured between roll 28 and roll 48, and $t_7$ is measured just above roll 42. A Rothschile Tensionmeter Model R1092 is used for measuring all tensions.

TABLE 2

| PROCESS CONDITIONS ITEM | A | B | C | D | E | F | G | H |
|---|---|---|---|---|---|---|---|---|
| Feed Roll Surface Temp. (° C.) | 30 | 30 | 120 | 120 | 120 | 190 | 185 | 185 |
| Roll 28 Speed (meters per minute) | 3814 | 3306 | 3776 | 3318 | 2660 | 3681 | 3061 | 2723 |
| Roll 28 Turbine Air Press (kilograms per square meter guage) | 0 | −21093 | 0 | −21093 | −42186 | 0 | −21093 | −42186 |
| Feed Roll 34 (meters per minute) | 4573 | 4573 | 4573 | 4573 | 4573 | 4573 | 4573 | 4573 |
| Winding Speed (meters per minute) | 4408 | 4396 | 4511 | 4517 | 4465 | 4542 | 4504 | 4504 |
| Underdrive (%) | 3.6 | 3.8 | 1.4 | 1.2 | 2.4 | 0.7 | 1.5 | 1.5 |
| Roll 30 Turbine Air Press (PSIG) | 0 | 0 | 0 | 0 | 0 | 0 | 0 | 0 |
| Roll 38 Speed (meters per minute) | 4418 | 4445 | 4546 | 4575 | 4577 | 4860 | 5020 | 4984 |
| Tensions (GMS) | | | | | | | | |
| $t_1$ | 8.5 | 8.5 | 7.5 | 8.0 | 8.0 | 8.0 | 7.5 | 7.5 |
| $t_2$ | 9.5 | 12.0 | 10.0 | 11.0 | 13.0 | 11.5 | 16.0 | 10.0 |
| $t_3$ | 7.0 | 7.0 | 7.3 | 8.0 | 7.0 | 7.5 | 8.8 | 8.0 |
| $t_4$ | 50 | 55 | 57 | 50 | 82 | 53 | 62 | 74 |
| $t_5$ | 49 | 54 | 50 | 48 | 71 | 51 | 50 | 65 |
| $t_6$ | 43 | 42 | 43 | 44 | 40 | 46 | 38 | 48 |
| $t_7$ | 35 | 28 | 31 | 30 | 36 | 44 | 33 | 28 |

Figure 3:
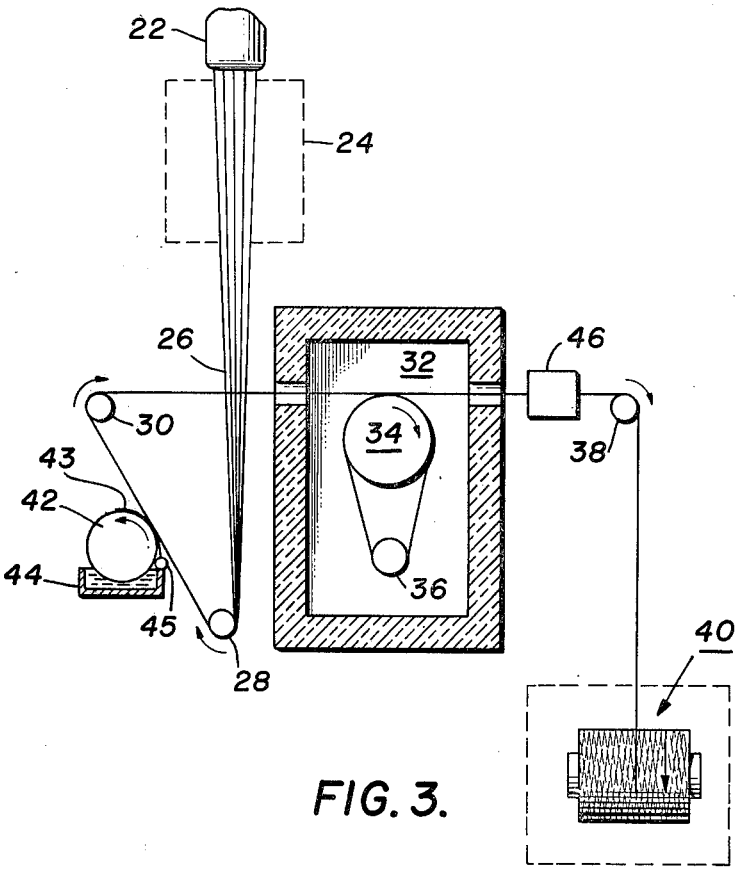
FIG. 3 is a schematic elevation view of modified apparatus for producing the novel yarns.

FIG. 3 illustrates an alternative machine configuration which differs from the FIG. 1 apparatus in that finish roll 42 is positioned after roll 28. This arrangement permits further flexibility in tailoring the physical properties of the yarn to a desired end use.

Table 3 sets forth representative processing conditions for the FIG. 3 configuration when making a weaving yarn. The polymer used in the Table 3 process contains 0.5% $TiO_2$ by weight and is selected so that the resulting yarn will have a relative viscosity of about 38. Quenching conditions are the same as for Items A–H above.

TABLE 3

| Item | I |
|---|---|
| Feed Roll Surface Temperature (° C.) | 183 |
| Roll 28 Turbine Air Pressure (kilograms per square meter guage) | −28124 |
| Roll 28 Approximate Speed (meters per minute) | 3067 |
| Feed Roll 34 Speed (meters per minute) | 4575 |
| Winding Speed (meters per minute) | 4475 |
| Winding Tension (grams) | 7 to 9 |
| Roll 30 Turbine Air Pressure (kilograms per square meter guage) | 0 |
| Roll 38 Turbine Air Pressure (kilograms per square meter guage) | 42186 |

Figure 4:
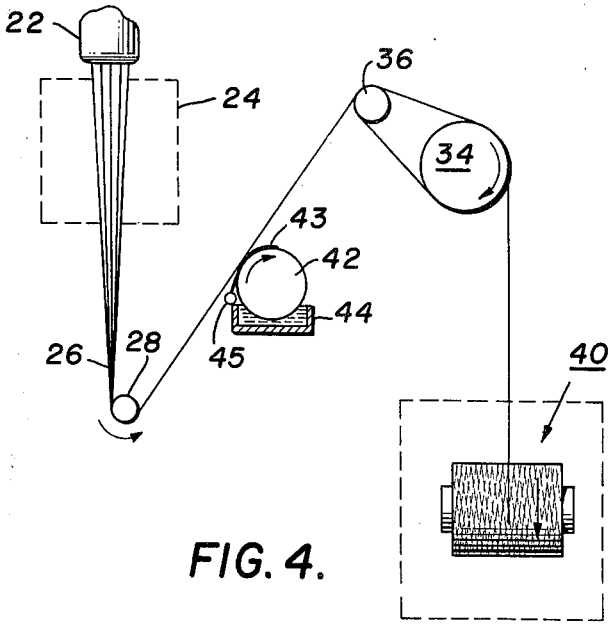
FIG. 4 is a schematic elevation view of a further modified apparatus for producing the novel yarns.

FIG. 4 illustrates a further apparatus and process particularly adapted for making feed yarns for texturing, the textured yarn in fabric form having a soft luxuriant hand. Roll 28 is positioned 317.5 centimeters (125 inches) below spinneret 22. Yarn 26 makes a partial wrap of about 180° around roll 28. The distance from roll 28 to roll 36 is 121.9 centimeters (48 inches). While roll 28 is the same as in FIGS. 1 and 3 above, roll 34 has a diameter of 14.98 centimeters (5.9 inches) in this example. Yarn 26 makes six and a fraction wraps about rolls 36 and 34, giving a total residence or contact time on roll 34 of about 18.6 milliseconds at the speed indicated below.

Table 4 shows exemplary operating conditions for the FIG. 4 apparatus. The polymer and the quenching conditions in the Table 4 process are the same as for the Table 3 process.

TABLE 4

| ITEM | J |
|---|---|
| Feed Roll Surface Temperature, ° C. | 158 |
| Feed Roll Speed (meters per minute) | 4710 |
| Roll 28 Speed Without Yarn (meters per minute) | 3042 |
| Winding Speed (meters per minute) | 3952 |
| Tension Just Above Roll 28 (gms.) | 34 |
| Tension Between Rolls 28 and 42 (gms.) | 16 |
| Tension Between Rolls 42 and 36 (gms.) | 21 |
| Winding Tension (gms.) | 8 |

The yarns produced by Items A–J are tested by the following procedures.

MACROSCOPIC PHYSICAL PROPERTIES TESTING PROCEDURES

All macroscopic physical property tests which are performed are conducted under the following conditions: 22.2°–24.5° C. (74° ± 2° F.) and 72% ± 2% RH. With the exception of retraction, all samples are conditioned in this controlled environment for at least three days prior to testing. All bobbins are stripped of surface defects or a minimum of 25 meters of yarn prior to testing.

Normal Boiling Water Shrinkage Method

After stripping sufficient yarn to eliminate any surface defects (a minimum of 25 meters) on the bobbin, a skein of yarn is wound on a Suter Silk Reel, Singer Reel or equivalent which winds 1.125 meters of yarn per revolution. A sample having a weight of 1.125 grams is wound, removed from the reel and the ends of yarn are tied together. Winding tensions are 2 grams maximum up to 400 denier, 6 ± 2 grams for 400–800 denier and 8 ± 2 grams for 800–1700 denier. A No. 1 paper clip (weighing approximately 0.51 grams) is attached to the skein in a manner to encompass the full filament bundle. The skein is then hung over a 1.27 centimeter (½ inch) diameter stainless steel rod which is then placed in front of a shrinkage measuring board (a precision chart to determine sample length). A 1000 gram weight is attached to the paper clip and after a 30-second wait, the sample length ($L_o$) is determined. Care is taken to eliminate parallax errors in reading sample length.

The 1000 gram weight is removed and replaced with a 284 gram brass weight; this weight is not removed until the final length measurement is to be made. The rod, the skein of yarn and the attached 284 gram weight is suspended (with the weight applying full tension) is a vigorously boiling covered water bath for 10 ± 2 minutes. The rod with its associated yarn skein and weight is removed and excess water allowed to drain (2–3 minutes). Then the samples are placed in a forced draft oven in such a manner that they remain under full tension for 15 minutes. The oven temperature is controlled at 115°± 5° C. The rod and its associated weighted skein is removed from the oven and returned to the shrinkage measuring board where it is allowed to hang for a minimum of 10 minutes (but no greater than 30 minutes). The attached 284 gram weight is removed and replaced with the 1000 gram weight, and 30 seconds thereafter the final length ($L_f$) is measured. The shrinkage (S) is then calculated as follows:

$$\% S = \frac{(L_o - L_f) \times 100}{L_o}$$

If nine consecutive samples are measured the average shrinkage level of the yarn on the bobbin at 95% confidence will be within ± 0.24 of the true value.

All shrinkages are determined by this method, or determined by the short length method described below and calculated or corrected to correspond to the normal boiling water shrinkage method.

Short Length Boiling Water Shrinkage Method

This method is used only when the test sample is not of sufficient length to directly determine the normal boiling water shrinkage (S). A sample length of at least 70 cm. is treated in the following manner. A knot is tied on each end of the filament bundle to prevent the filaments from disengaging from the threadline bundle during subsequent operations. The sample is then clamped at one end and a weight attached to the free end which places the sample under a tension of 0.1 grams per denier. The sample is mounted in such a manner that no contact is made with any other surfaces. While the sample is in this position, two marks are made 50 cm. apart with an indelible pen on the fiber bundle. The sample is then placed on a piece of cheesecloth approximately 28 centimeters (11 inches) square in the following manner. The yarn is formed into a loose coil having a diameter between 5 and 7.6 centimeters (2 and 3 inches) which is placed in the center of the flat cheesecloth. Fold one side of the cheesecloth wrapper over the coil, then fold opposite side and overlap initial fold. Repeat this operation on the other sides and secure the last folds made by applying a No. 1 paper clip perpendicular to the last folds. This secures the package and does not apply any restraining forces to the yarn coil. The resultant package is flat and about 7.6 centimeters (3 inches) square. The package is then submerged in boiling water for 20 ± 2 minutes. After the package is removed, it is cooled with tap water and excess moisture is removed from the package with a sponge. The sample is then carefully removed from the cheesecloth and suspended without any tension applied to the threadline for 2 ± 0.1 hours.

The sample is again tensioned with the original 0.1 gram per denier weight and the distance between the two marks measured ($L_f$) in cm. The short length shrinkage (S*) is then determined as follows:

$$\%S^* = \frac{(L_o - L_f) \times 100}{L_o}$$

A surprisingly good correlation exists between the normal boiling water shrinkage S and the short length boiling water shrinkage S* as shown by a coefficient of correlation of 0.9670. The estimated normal boiling water shrinkage (S) can be determined by the following relationship:

$$\%S = (0.96428)(\%S) - 0.41884$$

It will be noted that the estimated normal boiling water shrinkage S shows a lower value then the short length boiling water shrinkage S*.

If a yarn sample having a length of at least 70 cm is not available, shorter length samples can be used and the normal boiling water shrinkage calculated as noted above, however, accuracy decreases with decreasing sample length.

Retraction Method

Retraction is measured within 28 hours after the yarn is produced. A minimum of 914 meters (1000 yards) is stripped from the freshly wound bobbin. A skein of yarn is then wound on a Suter Silk Reel or equivalent, which winds 1.125 meters of yarn per revolution. A sample having a weight of 1.125 grams is wound, removed from the reel and the yarn ends are tied together. Winding tensions are 2 grams maximum up to 400 denier, 6 ± 2 grams for 400–800 denier, and 8 ± 2 grams for 800–1700 denier. A No. 1 paper clip (weighing approximately 0.51 grams) is attached to the skein in a manner to encompass the full filament bundle. The skein is then hung over a 1.27 centimeter (½ inch) diameter stainless steel rod which is then placed in front of a shrinkage measuring board (a precision chart to determine sample length). A 1000 gram weight is attached to the paper clip and, after a 30-second wait, the sample length ($L_o$) is determined. Care is taken to eliminate parallax errors in reading sample length.

The 1000 gram weight is removed and the sample is allowed to hang for 24 ± 0.1 hours. The 1000 gram weight is attached to the paper clip and 30 seconds thereafter the final length ($L_f$) is measured. The percent retraction ($S_r$) is then calculated as follows:

$$\%S_r = \frac{L_o - L_f \times 100}{L_o}$$

Tensile Properties

The stress-strain properties are measured with an Instron Tensile Tester (Model No. TMM, manufactured by the Instron Engineering Corporation of Quincy, Mass.) using a load cell and amplification which will cause the point of maximum deflection of the stress-strain curve to be greater than 50% of the width of the recording chart. The sample length is 25 cm, the rate of extension is 120% per minute, and the chart speed is 30 cm per minute.

The initial modulus is defined as 100 times the force in grams per denier (g/d) required to stretch the yarn the first 1%.

In determining the tangent moduli, 10% modulus ($M_t$) and final modulus ($M_f$), the calculated deniers at the given strains are used. For a given strain (E), expressed as the ratio of sample extension (change in length) to original sample length, the calculated denier is given by the following relationship:

$$D = \frac{D_o}{1 + E}$$

The calculated denier D at 0.1 strain, that is, when the yarn has been stretched to a total length of 27.5 cm., is thus equal to $D_o/1.1$.

The 10% modulus ($M_t$) is defined as follows:

$$M_t = \frac{P_{.1} - P_{.09}}{(.01)\,D}$$

where $P_{.1}$ is the force in grams at a strain of 0.1, $P_{.09}$ is the force in grams at a strain of 0.09, and D is the calculated denier at 0.1 strain.

The final modulus ($M_f$) is calculated at the point of first filament breakage. The force $P_f$ at this strain $E_f$ is used with the force $P_y$ at a strain $E_y$ equal to $E_{(f-.05)}$. The final modulus $M_f$ is calculated as follows:

$$M_f = \frac{P_f - P_y}{(0.05)\,D}$$

where $P_f$ and $P_y$ are the forces noted and D is the calculated denier at strain $E_f$.

In some cases, the point of first filament breakage ($E_f$, $P_f$) occurs prior to reaching the point of maximum force ($E_m$, $P_m$). Only those stress-strain curves which have a $P_f/P_m$ ratio of at least 0.95 are used to calculate the values of $M_i$, $M_t$ and $M_f$.

The modulus ratio (R) is calculated as follows:

$$R = \frac{M_t}{M_f}$$

The stress index $\alpha$ is defined as follows:

$$\alpha = \frac{200}{P_{.1}}(P_{.05} - 0.45P_{.1})$$

where $P_{.05}$ is the force in grams at 0.05 extension and $P_{.1}$ is the force in grams at 0.1 extension.

The elongation at break is a percentage, defined as 100 times $E_m$.

Uster Uniformity

Denier uniformity is determined using the Uster Evenness Tester, Model C. together with Integrator ITG-101 for this instrument. The yarn speed is 182.8 meters per minute (200 YPM), the service selector is set on normal, and the sensitivity selector is set to 12.5%. The %U is read from the integrator after a sample run time of 5 minutes.

Yarn Relative Viscosity

Relative viscosity (R.V.) is defined as the ratio of the absolute viscosity in centipoises at 25° C. of a solution containing 8.4 parts by weight of the yarn dissolved in 91.6 parts by weight of 90% formic acid (10% by weight water and 90% by weight formic acid) to the absolute viscosity at 20° C. In centipoises of the 90% formic acid.

YARN PROPERTIES

Table 5 shows the physical properties of the yarns produced by the processes disclosed above, and compares these properties with those of commercially available yarns having the same nominal denier and the same number of filaments. The data reported are the average of at least five bobbins for all items. Item K is a commercially available nylon 66 premium quality yarn produced by a single-stage-draw coupled process; Item L is a commercially available nylon 66 premium quality yarn believed to be produced by a two-stage-draw coupled process; Item M is a commercially available nylon 66 yarn produced by a two-stage-draw coupled process, and Item N is a commercially available nylon 66 yarn produced by the split process. Items K, L and M are relaxed yarns, that is, they were heat-treated under appropriate tensions so as to reduce the shrinkage. Item N was not heat-treated and is not a relaxed yarn, as evidenced by the high shrinkage. All items are flat (untextured) yarns.

TABLE 5

| ITEM | A | B | C | D | E | F | G | H | I | J | K | L | M | N |
|---|---|---|---|---|---|---|---|---|---|---|---|---|---|---|
| Properties: | | | | | | | | | | | | | | |
| Drawn Denier, $D_o$ | 70 | 70 | 68 | 68 | 69 | 67 | 68 | 68 | 70 | 86 | 69 | 71 | 71 | 71 |
| Tenacity, (g/d) | 3.8 | 4.4 | 3.9 | 4.5 | 4.7 | 3.9 | 4.8 | 4.9 | 5.2 | 4.3 | 5.3 | 5.2 | 4.6 | 5.0 |
| Elongation, (%) | 57 | 52 | 55 | 46 | 39 | 45 | 44 | 37 | 43 | 59 | 39 | 26 | 38 | 31 |
| Shrinkage, S (%) | 5.5 | 6.2 | 6.0 | 6.6 | 7.8 | 5.4 | 6.0 | 6.5 | 5.6 | 4.0 | 5.0 | 4.0 | 6.9 | 10 |
| Uster unevenness (%U) | .67 | .57 | .64 | .63 | .55 | .59 | .52 | <.50 | <.50 | 1.3 | .67 | .69 | 1.2 | 1.5 |
| Initial Modulus, $M_i$ (g/d) | 19 | 21 | 19 | 25 | 27 | 23 | 24 | 27 | 29 | 21 | 25 | 25 | 25 | 28 |
| 10% Modulus, $M_1$ (g/d) | 8.2 | 11 | 9.1 | 13 | 17 | 12 | 16 | 20 | 15 | 9.6 | 30 | 23 | 34 | 31 |
| Final Modulus, $M_f$ (g/d) | 8.2 | 8.5 | 8.4 | 9.0 | 9.3 | 8.0 | 8.9 | 9.5 | 7.6 | 7.1 | 7.4 | 6.5 | 4.9 | 5.2 |
| Modulus Ratio (R) | 1.0 | 1.3 | 1.1 | 1.5 | 1.8 | 1.5 | 1.8 | 2.1 | 2.0 | 1.4 | 4.2 | 3.7 | 7.1 | 6.1 |
| Stress Index (α) | 31 | 23 | 32 | 21 | 9 | 26 | 18 | 9 | 28 | 37 | −6 | −5 | −9 | −2 |

X-RAY ANALYSIS

Final Spun Yarn Sample

These samples are obtained using two electrically actuated simultaneous cutters for cutting out a yarn sample. The samples were taken at a location just prior to contact of the freshly solidified filaments with the first surface which they contact. In the FIG. 1 apparatus, the sample would thus be taken just above roll 42, while in the other illustrated embodiments, it would be taken just above roll 28. The samples thus cut from the running yarn are placed in a moisture-free environment as soon as possible and maintained dry throughout the X-ray exposure to be described. Placing the yarn sample immediately after cutting into a box previously flushed with dry nitrogen gas, closing the box and pressurizing the box with dry nitrogen gas is a satisfactory technique.

Reference Spun Yarn Sample

These samples are made using an identical polymer type, conventionally spun. The spun yarn is steamed prior to being wound on a conventional spin bobbin at 1463 meters/minute. The spin bobbin is then lagged for 2 days in an air atmosphere at about 23° C. and 70% relative humdity. A length of yarn is cut from the bobbin after stipping about 100 yards of surface yarn.

X-Ray Techniques

The X-ray diffraction patterns are recorded on NS54T Kodak no-screen medical x-ray film using evacuated flat plate Laue cameras (Statton type). Specimen to film distance is 5.0 cm; incident beam collimator length is 3.0 inches, exposure times 25 minutes. Interchangeable Statton type yarnholders with 0.5 mm diameter pinholes and 0.5 mm yarn sheaf thickness are used throughout as well as 0.5 mm entrance pinholes. The filaments of each sheaf of yarn are aligned parallel to one another and perpendicular to the x-ray beam. A copper fine focus x-ray tube ($\lambda = 1.5418$Å) is used with a nickel filter at 40 KV and 26.26 mA, 85% of their rated load. For each x-ray exposure, three films are used in the film cassettes. The front, most intense film provide information on any weak diffraction maxima. The second and third films, lighter by factors of approximately 3.8 and 14.4 respectively, yield details on the more intense maxima and provide reference intensities used in estimating particle size and orientation from spot widths.

The principal equatorial x-ray diffraction maxima are used to determine the average lateral crystal particle size. For the (100) reflection this corresponds to the average width of the hydrogen bonded sheets of polymer chains, and for the higher angle (010) reflection this corresponds to the thickness of the crystallities in the direction of packing of the hydrogen bonded sheets. These sizes are estimated from the breadth of the diffraction maxima using Scherrer's method, $$D = \frac{K\lambda}{\beta\cos\theta},$$

where K is the shape factor depending on the way $\beta$ is determined as discussed below, $\lambda$ is the x-ray wave length, in this case, 1.5418 Å, $\theta$ is the Bragg angle, and $\beta$ is the spot width in respect to 2 $\theta$ in radians.

Warren's correction for line broadening due to instrumental effects is used as a correction for Scherrer's line broadening equation, $$W^2 = w^2 + \Omega^2$$

where W is the measured line width, $w = 0.39$ mm is the instrumental contribution obtained from inorganic standards, and $\Omega$ is the corrected line width used to calculate the spot width in radians, $\beta$. The measured line width W, is taken as the width at which the diffraction intensity on a given film falls to the maximum intensity of the corresponding next lighter film, or approximately the width at 1/3.8 of the maximum intensity. Correspondingly, a value of 1.16 is employed for the shape factor K in Scherrer's equations. Any broadening due to variation of periodicity is neglected.

Crystalline orientation is determined from the angular widths, $\phi$ 1/3.8, of the two principal equatorial reflections (010) and (100). These are estimated visually at 1/3.8 peak height using successive films in the film cassette for reference. These are converted to Herman's orientation functions, $$F = \frac{3}{2} <\cos^2\phi> - \frac{1}{2},$$

assuming Gaussian peak shapes, $$I(\phi) \approx (h/\pi) \exp(-h^2\phi^2).$$

This representation has been reported to be satisfactory in many cases by Dumbleton et al [J. H. Dumbleton, D. R. Buchanan, and B. B. Bowles, *J. Appl. Polymer Sci.*, 12, 2067–2076 (1968)]. The shape of the peak is then given by a single factor, such as the peak width at 1/3.8 height, related to $h$ by, $$h = 2.311/\phi 1/3.8$$

For samples for which $\phi 1/3.8$ is greater than 180°, $h$ is estimated from the ratio of the intensity at 90° (i.e. on the meridan) to that on the equator, $$I_{90}/I_o = \exp\text{-}(90h)^2$$

In particular the mean square cosines are calculated by numerical integration using an HP-65, $$<\cos^2\phi> = \int_0^{90} I(\phi)\cos^2\phi\sin\phi d\phi / \int_0^{90} I(\phi)\sin\phi d\phi$$

which is a weighted mean with weights equal to the number of poles at any given angle $\phi$.

Crystalline orientation of the molecular chains is obtained following Wilchinsky's general treatment (Z. W. Wilchinsky, *Advances in X-Ray Analysis, Vol.* 6, Plenum Press, New York, 1963, pages 231–241. Described by L. E. Alexander, *X-Ray Diffraction Methods in Polymer Science,* John Wiley, 1969, pages 245–252). The equatorial (010) and (100) orientations are found to be similar, indicating near randomness about the C-axis; so the molecular chain or C-axis orientation simplifies to $<\cos^2\phi_{c,Z}> = 1 - 2.<\cos^2\phi_{010,Z}>$, where $\cos\phi_{010,Z}$ is the cosine of the angle between the fiber direction Z and the normal of the reflecting (010) planes, and $\cos\phi_{c,Z}$ is the similar cosine with respect to the C-axis (molecular chain direction). In terms of Herman's crystalline orientation function, the C-axis orientation function simplies to:

$$F_c = -2F_{(010)}$$

where $F_{010}$ is the b-axis orientation function, or more precisely in this triclinic case the orientation in respect to the $b^*$ reciprocal axis which is perpendicular to the C-axis.

In the present process, the molten polymer streams are subjected to much higher than normal stresses as they are attenuated to smaller than normal spun deniers. The molten streams are thus quenched more rapidly, and the resulting solidified spun yarn has a smaller hydrogen bonded sheet width than conventional yarns entering the draw zone.

As can be seen from a comparison of Tables 2–5, for a given speed of draw roll 34, yarn properties are controlled bt varying the speeds of rolls 28, 30 and 38, and thus the yarn tensions, and by varying the temperature of roll 34. Generally speaking, slowing of either roll 28 or roll 30 relative to the speed of roll 34 increases tenacity and modulus values, and increases denier uniformity as measured by Uster analysis. The process is unusual in this latter respect, as well as in the achievement at such low processing tensions of yarn tenacities, elongations, and initial moduli similar to conventionally drawn yarn. It is likewise noteworthy that tenacity increases as the temperature of roll 34 increases, this being unexpected in view of the prior art.

A further factor which becomes important in forming large packages on disposable bobbins made of paper is that the retraction should be below 1%. Items A and B above (run without positively heating roll 34) have retractions above this value, and must be run on stronger and more expensive bobbins if satisfactory large packages are to be made without crushing the bobbin. Items C–J have retractions well below 1%, and can be conveniently wound on inexpensive paper bobbins. Of particular interest is the decrease in tension after roll 28 in Item J.

Yarn uniformity as measured by Uster analysis shows that Items A–G are at least comparable in average uniformity to the best available commercial yarns (Items K and L), while Items H and I are superior in this respect.

In addition to the yarn uniformity as measured by Uster analysis, the yarns in Items A–I exhibit a novel combination of shrinkage and stress-strain properties as indicated by the reported shrinkage and modulus values.

The last five properties listed in Table 5 are derived from a stress-strain diagram as detailed above. The initial modulus is a commonly measured parameter. The 10% modulus and the final modulus are tangent moduli, representing the stiffness of the yarn near 10% extension (0.1 strain) and near break, respectively. The modulus ratio is the ratio of the 10% modulus to the final modulus, and provides a measure of the general shape of the stress-strain curve. Finally, the stress index $\alpha$ is derived from the stresses at 5% and 10% extensions, and relates to the unusual soft hand observed in various fabrics made from yarns.

Yarns having the unusual softness of hand are those having a positive stress index $\alpha$ combined with a shrinkage less than 8.5% and an initial modulus greater than 15. The softness usually is more pronounced when $\alpha$ exceeds 15, and particularly so when the 10% modulus also is less than 17.

Suitable yarns for warping (for weaving or warp knitting) are those having an initial modulus of at least 17, a shrinkage typified by items D, E, G, and H. For filling yarns is weaving, the shrinkage should be between 1 and 6%, the initial modulus should be at least 17, and the yarn should have a modulus ratio less than 3, as exemplified by Item I. Advantageously, the initial modulus also exceeds 21 grams per denier (g/d). These warping and filling yarns preferably have elongations between 25 and 60% and final moduli greater than 7.5 g/d.

Suitable feed yarns for knitting or texturing such as Item E, have a shrinkage less than 8.5%, an initial modulus of at least 15 and a 10% modulus less than 22 g/d. These feed yarns for knitting or texturing preferably have elongations between 35 and 80%. For shock absorbing applications (e.g., tow ropes, anchor lines, barriers for restraining or confining vehicles, etc.), elongations preferably range between 35 and 120%.

Yarns of general utility, suitable for a wide variety of end uses including those mentioned above, have a shrinkage between 1 and 8.5%, a 10% modulus less than 22 g/d, a final modulus greater than 7.5 g/d, and a modulus ratio less than 3. Preferably such yarns have elongations between 35% and 60%.

These properties may be compared with further representative commercially available split process nylon 66 flat yarns, and with two experimental yarns, as shown in Table 6. In Table 6, Item 0 is 840 denier, 140 filament tire yarn; Item P is 20 deneir, 7 filament yarn intended to be textured and knit into sheer hose; Item Q is 840 denier, 140 filament relaxed industrial yarn. The two experimental yarns, Items R and S, are made from split process spun yarns designed to be drawn to 70 denier, but are deliberately underdrawn to 89 and 82 denier, respectively.

Table 6

| Item | 0 | P | Q | R | S |
|---|---|---|---|---|---|
| Initial modulus (g/d) | 47 | 37 | 22 | 32 | 35 |
| 10% modulus (g/d) | 69 | 31 | 68 | 19 | 23 |
| Final modulus (g/d) | 23 | 5 | 20 | 7 | 6.5 |
| Modulus ratio (R) | 3 | 6.2 | 3.5 | 2.7 | 3.5 |
| Shrinkage (%) | 10 | 10 | 4.9 | 12 | 11 |
| Stress index ($\alpha$) | −19 | −3.7 | −22 | 12 | 10 |

None of these items have combinations of properties comparable to Items A–J above. Item O, while having a final modulus of 23, has a very high 10% modulus, together with high shrinkage and a negative stress index $\alpha$. Item P has all properties (aside from initial modulus) outside the ranges for the yarns of the invention. Item Q has an acceptably high final modulus and low shrinkage, but the other properties are far outside the ranges for the yarns of the invention.

Experimental Items R and S, which do exhibit the desirable positive values for the stress index $\alpha$, couple this with shrinkages as high as tire yarn and low final moduli.

Yarns according to the invention accordingly have unique and desirable combinations of physical properties, which combinations are not present in the prior art.

We claim:

1. A process for producing a yarn from a thermoplastic melt-spinnable polyamide polymer, said process comprising:
   a. extruding said polymer through a spinneret as a plurality of molten streams into a quench zone wherein the streams are cooled and solidified into spun filaments;
   b. forwarding said spun filaments with control means comprising a roll for controlling the spinning speed of said filaments by withdrawing said spun filaments from said quench zone at a spinning speed of at least 2285 meters per minute;
   c. feeding said filaments from said control means into an orientation zone between 0.002 and 0.25 seconds after solidfication of said filaments; and
   d. stretching said filaments in said orientation zone.

2. The process defined in claim 1, wherein said filaments are fed into said orientation zone between 0.01 and 0.12 seconds after solidfication.

3. The process defined in claim 1, wherein said control means comprises an unpaired roll about which said filaments pass.

4. The process defined in claim 3 wherein said filaments contact said unpaired roll for less than 360°.

5. The process defined in claim 3, wherein a substantially constant torque is applied to said unpaired roll.

6. The process defined in claim 3, wherein said unpaired roll is driven by an air turbine.

7. The process defined in claim 6, wherein said air turbine applies a torque to said unpaired roll in a direction to oppose driving of said unpaired roll by said yarn.

8. The process defined in claim 1, further comprising:
   a. forwarding said filaments from said orientation zone to a heat treatment zone; and
   b. heating said filaments in said heat treatment zone while under a tension between 0.1 and 1.5 grams per final denier to a yarn temperature between 50° C. and 240° C. for a period of time sufficient to reduce the underdrive to less than 5%.

9. The process defined in claim 1, further comprising:
   a. forwarding said filaments from said orientation zone to a heat treatment zone; and
   b. heating said filaments in said heat treatment zone while under a tension between 0.1 and 1.5 grams per final denier to a temperature between 50° C. and 250° C. for a period of time sufficient to reduce the yarn retraction to less than 1%.

10. The process defined in claim 1, wherein said polyamide polymer is nylon, 66, and wherein the spinning speed is selected so that a final spun yarn sample has a crystalline orientation Fc of at least 0.78.

11. The process defined in claim 10, wherein said crystalline orientation Fc is at least 0.85.

12. The process defined in claim 2, wherein said crystalline orientation Fc is at least 0.85.

13. The process defined in claim 3, wherein said crystalline orientation Fc is at least 0.85.

14. The process defined in claim 4, wherein said crystalline orientation Fc is at least 0.85.

15. The process defined in claim 5, wherein said crystalline orientation Fc is at least 0.85.

16. The process defined in claim 6, wherein said crystalline orientation Fc is at least 0.85.

17. The process defined in claim 7, wherein said crystalline orientation Fc is at least 0.85.

18. The process defined in claim 8, wherein said crystalline orientation Fc is at least 0.85.

19. The process defined in claim 9, wherein said crystalline orientation Fc is at least 0.85.

20. The process defined in claim 1, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

21. The process defined in claim 2, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

22. The process defined in claim 3, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

23. The process defined in claim 4, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

24. The process defined in claim 5, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

25. The process defined in claim 6, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

26. The process defined in claim 7, wherein said polyamide polymer is nylon 66, and wherein said spinning speed is selected so that a final spun yarn sample has a crystallite hydrogen bonded sheet width so greater than 85% of the crystallite hydrogen bonded sheet width of a reference spun yarn sample.

27. The process defined in claim 8, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

28. The process defined in claim 9, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

29. The process defined in claim 10, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

30. The process defined in claim 11, wherein said polyamide polymer is nylon 66, and wherein said spinning speed is selected so that a final spun yarn sample has a crystallite hydrogen bonded sheet width no greater than 85% of the crystallite hydrogen bonded sheet width of a reference spun yarn sample.

31. The process defined in claim 20, wherein said crystallite hydrogen bonded sheet width is no greater than 75% of the crystallite hydrogen bonded sheet width of a reference spun yarn sample.

32. The process defined in claim 21, wherein said crystallite hydrogen bonded sheet width is no greater than 75% of the crystallite hydrogen bonded sheet width of a reference spun yarn sample.

33. The process defined in claim 22, wherein said crystallite hydrogen bonded sheet width is no greater than 75% of the crystallite hydrogen bonded sheet width of a reference spun yarn sample.

34. The process defined in claim 23, wherein said crystallite hydrogen bonded sheet width is no greater than 75% of the crystallite hydrogen bonded sheet width of a reference spun yarn sample.

35. The process defined in claim 24, wherein said crystallite hydrogen bonded sheet width is no greater than 75% of the crystallite hydrogen bonded sheet width of a reference spun yarn sample.

36. The process defined in claim 25, wherein said crystallite hydrogen bonded sheet width is no greater than 75% of the crystallite hydrogen bonded sheet width of a reference spun yarn sample.

37. The process defined in claim 26, wherein said crystallite hydrogen bonded sheet width is no greater than 75% of the crystallite hydrogen bonded sheet width of a reference spun yarn sample.

38. The process defined in claim 27, wherein said crystallite hydrogen bonded sheet width is no greater than 75% of the crystallite hydrogen bonded sheet width of a reference spun yarn sample.

39. The process defined in claim 28, wherein said crystallite hydrogen bonded sheet width is no greater than 75% of the crystallite hydrogen bonded sheet width of a reference spun yarn sample.

40. The process defined in claim 29, wherein said crystallite hydrogen bonded sheet width is no greater than 75% of the crystallite hydrogen bonded sheet width of a reference spun yarn sample.

* * * * *